US006295967B1

(12) United States Patent
Weber et al.

(10) Patent No.: US 6,295,967 B1
(45) Date of Patent: Oct. 2, 2001

(54) POWERTRAIN OUTPUT MONITOR

(75) Inventors: Charles Francis Weber, South Lyon; Ross Dykstra Pursifull, Dearborn; Allan Joseph Kotwicki, Williamsburg, all of MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/488,818

(22) Filed: Jan. 20, 2000

(51) Int. Cl.[7] ..... F02D 7/00
(52) U.S. Cl. ..... 123/399; 123/361
(58) Field of Search ..... 123/399, 361, 123/351, 352

(56) References Cited

U.S. PATENT DOCUMENTS

| | | | | |
|---|---|---|---|---|
| 4,094,274 | | 6/1978 | Harada et al. . | |
| 4,359,028 | * | 11/1982 | Fiala | 123/399 |
| 4,635,607 | | 1/1987 | Yasuoka et al. . | |
| 4,748,955 | | 6/1988 | Yonekawa et al. . | |
| 4,890,590 | | 1/1990 | Iwamoto et al. . | |
| 5,048,481 | | 9/1991 | Chan et al. . | |
| 5,048,482 | | 9/1991 | Kratt et al. . | |
| 5,074,267 | | 12/1991 | Ironside et al. . | |
| 5,079,946 | | 1/1992 | Motamedi et al. . | |
| 5,086,740 | * | 2/1992 | Wiggins et al. | 123/361 |
| 5,146,892 | | 9/1992 | Krampe et al. . | |
| 5,204,816 | | 4/1993 | Wright et al. . | |
| 5,255,653 | | 10/1993 | Ironside et al. . | |
| 5,370,094 | | 12/1994 | Sorg et al. . | |
| 5,372,110 | * | 12/1994 | Boverie et al. | 123/361 |
| 5,391,127 | | 2/1995 | Nishimura . | |
| 5,429,091 | | 7/1995 | Huber et al. . | |
| 5,553,581 | * | 9/1996 | Hirabayashi et al. | 123/399 |
| 5,623,905 | | 4/1997 | Kau et al. . | |
| 5,623,906 | * | 4/1997 | Storhok | 123/399 |
| 5,625,558 | * | 4/1997 | Togai et al. | 123/399 |
| 5,692,472 | | 12/1997 | Bederna et al. . | |
| 5,983,861 | * | 11/1999 | Nishio et al. | 123/399 |

* cited by examiner

*Primary Examiner*—Erick Solis
(74) *Attorney, Agent, or Firm*—John E. Kajander

(57) ABSTRACT

A powertrain control method for an internal combustion engine responsive to an accelerator pedal input, the engine having a throttle responsive to a commanded throttle position. The method comprises the steps of determining the engine speed, determining the accelerator pedal position, and generating a desired throttle position value as a function of at least the accelerator pedal position and engine speed. If the commanded throttle position is greater than the desired throttle position value, the commanded throttle position is limited to the desired value.

10 Claims, 2 Drawing Sheets

POWERTRAIN OUTPUT MONITOR

BACKGROUND OF THE INVENTION

The invention relates generally to control systems for internal combustion engines, and more particularly, concerns a powertrain output monitor for electronic throttle control-equipped vehicles.

Present powertrain output monitor techniques typically compute an estimate of engine output and compare that value to the requested engine output. Such methods typically take the form of resolving one or more engine operating parameters and comparing the estimated versus requested output value. Such operating parameters can include: engine output torque, engine output power, wheel torque, wheel power, and wheel acceleration. The requested output is typically a function of driver demand as measured by the accelerator pedal position, combined with internally automated demands such as idle speed control and catalyst heating.

Due to the complex nature of determining estimated and requested engine output as a function of one or more engine operating characteristics and driver inputs, diagnostics based upon such monitoring techniques are inherently complex. Therefore, there exists a need for a simplified method of monitoring the powertrain control system.

SUMMARY OF THE INVENTION

In view of the foregoing, it is an object of the invention to provide an improved method of monitoring the powertrain output. It is also an object to provide a simplified powertrain output monitor as compared to present output monitoring technologies.

According to the present invention, the foregoing and other objects and advantages are attained by a method of monitoring the powertrain controller for an internal combustion engine responsive to an accelerator pedal input, the engine having a throttle responsive to a throttle position command. The method comprises the steps of determining the engine speed, determining the accelerator pedal position, and generating a desired throttle position value. If the commanded throttle position is greater than the desired throttle position value, the commanded throttle position is set equal to the desired throttle position value.

In one aspect of the invention, the desired throttle position value is generated as a function of the accelerator pedal position. In another aspect, the desired throttle position value is generated as a function of the accelerator pedal position and engine speed. If the commanded throttle position is greater than the desired throttle position value, the commanded throttle position is limited to the desired value, or other powertrain control action is taken. Such action can include retarding or eliminating the spark timing, reducing the fuel quantity injected per engine stroke, or the fuel delivery rate.

An advantage of the present invention is that little or no field calibration is required. Another advantage is that few inputs are necessary, thus, the main control element interface is simplified.

Other advantages of the invention will become apparent upon reading the following detailed description and appended claims, and upon reference to the accompanying drawings.

BRIEF DESCRIPTION OF THE DRAWINGS

For a more complete understanding of this invention, reference should now be had to the embodiments illustrated in greater detail in the accompanying drawings and described below by way of examples of the invention. In the drawings.

DETAILED DESCRIPTION OF THE PREFERRED EMBODIMENT

Figure 1:
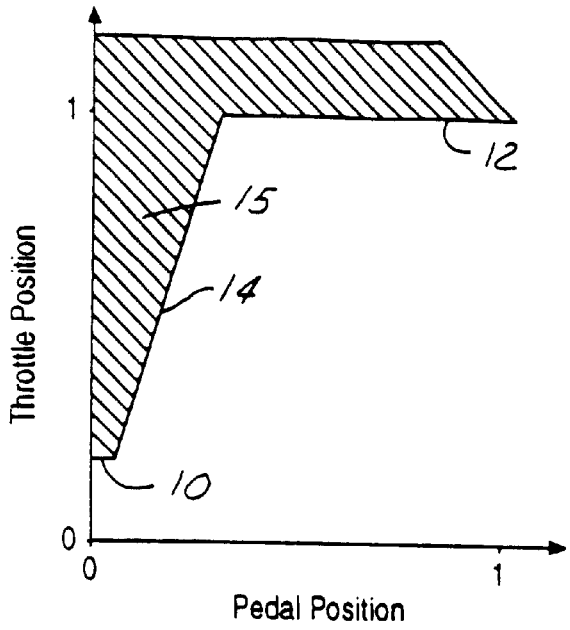
FIG. 1 is a graph of throttle position versus accelerator pedal positions.

Turning first to FIG. 1, there is shown a graph of the throttle position versus accelerator pedal position for an engine operating in steady state. As can be seen with reference to region 10 which corresponds to an accelerator pedal position of zero (i.e., the operator's foot is off-pedal), the throttle position should be near its minimum. In other words, it is undesirable to deliver a large quantity of air when in the foot-off-pedal condition since, in engines operating at stoichiometry or rich of stoichiometry, airflow correlates to power and cylinder air mass correlates to torque. Accordingly, the throttle position at foot-off-pedal, preferably is no greater than the maximum throttle position required for the highest idle torque desired. This corresponds to the region 10 in FIG. 1.

Similarly, when the accelerator pedal is equal to 1.0, i.e., fully deflected, the throttle position should be limited to fully open and no further. This is represented by region 12 in FIG. 1.

Also, when the pedal position transitions from 0.0 (foot-off-pedal) to an intermediate position such as 0.2, the throttle position preferably should not immediately be commanded to its maximum open value. Thus, the region 14 correlates to a desired pedal-to-torque gain for the particular engine under consideration.

Figure 2:
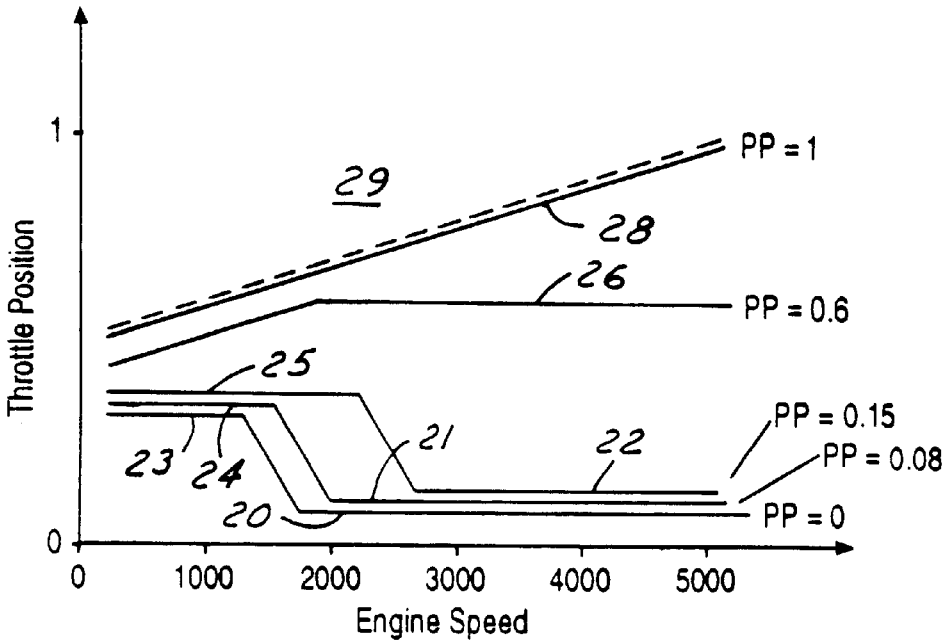
FIG. 2 is a graph of throttle position versus engine speed for various accelerator pedal positions.

FIG. 2 shows graphically a similar relationship for the throttle position as it relates to engine speed and accelerator pedal position. When the pedal position (PP) is 0.0 (foot-off-pedal), and the engine speed is above 1600 RPM, the throttle position is minimized as shown as point 20 of FIG. 2. Similarly, when the pedal position is only slightly deflected (PP=0.08) and the engine is operating approximately 2000 RPM, the throttle position is minimized as shown at point 21. The difference between the minimum throttle position value for the various pedal positions, i.e., between points 20, 21 and 22, allows for engine braking modulation. In this example, the more the pedal deflects, the less engine braking desired. Similarly, the regions 23, 24 and 25 correspond to the maximum throttle position for near-idle conditions. At a certain pedal position such as PP=1.0, the throttle position clip or detection threshold is preferably maximized in accordance with engine speed to allow for the greatest amount of torque. This is shown in FIG. 2 as line 28. Line 26 represents the throttle position as it relates to a medium pedal deflection value.

From the foregoing graphs illustrated in FIGS. 1 and 2, a relationship can be seen between accelerator pedal position and throttle position from which an effective engine output monitoring scheme can be created.

Figure 3:
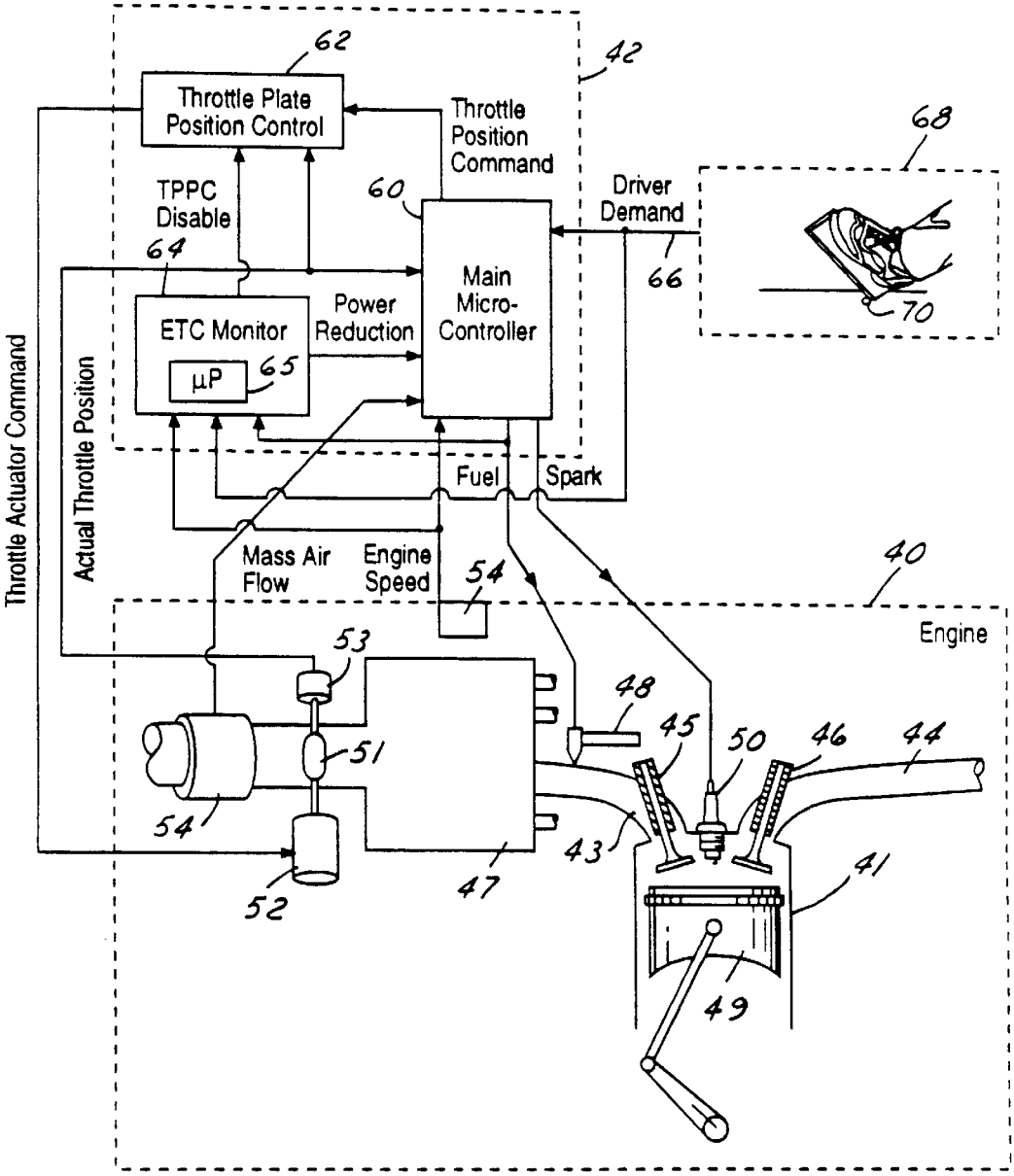
FIG. 3 is a schematic diagram of an internal combustion engine and associated control system according to one embodiment of the present invention.

Referring now to FIG. 3, there is shown a schematic diagram of an internal combustion engine 40 and associated powertrain control module 42 as well as an operator interface 68 in accordance with one embodiment of the present invention.

The engine 40 includes a plurality of combustion chambers 41 each having an associated intake 43 and exhaust 44 operated by respective valves 45, 46. Combustion occurs as a result of the intake of air and fuel from the intake manifold 47 and fuel injector 48 respectively, compression by the piston 49 and ignition by the spark plug 50. Combustion gases travel through the exhaust manifold 44 to the downstream catalytic converter and are emitted out of the tailpipe. A portion of the exhaust gases may also be recirculated back through the intake manifold 47 to the engine cylinders 41.

The airflow through the intake manifold 47 is controlled by a throttle comprising a throttle plate 51 and throttle actuator 52. A throttle position sensor 53 measures the actual throttle position. Mass airflow sensor 54 measures the amount of air flowing into the engine 40. An engine speed sensor 54 provides value indicative of the rotational speed of the engine 40.

The powertrain control module (PCM) 42 receives as inputs the throttle position signal, the mass airflow signal, the engine speed signal, and the driver demand inputs. In response, the PCM 42 controls the spark timing of the spark plugs 50, the pulse width of fuel injectors 48 and the position of the throttle 51 by way of the throttle actuator 52. All of these inputs and outputs are controlled by the main microcontroller 60. The main microcontroller 60 controls the throttle position by outputting a throttle position command to the throttle plate position controller 62 to drive the throttle actuator 52 to the desired position.

The PCM 42 includes an electronic throttle control (ETC) monitor 64 which communicates with the main microcontroller 60 and throttle plate position controller 62. The ETC monitor 64 includes a microprocessor 65 and associated memory separate from the microprocessor in the main microcontroller 60. The ETC monitor 64 receives as inputs the engine speed signal from engine speed sensor 54, and the driver demand signal 66 which represents, among other things, the accelerator pedal position 70. As will be described in further detail below, the ETC monitor 64 monitors the commanded throttle position.

Although the ETC monitor 64 is shown separate from the main microcontroller 60, it is to be understood that it could also be wholly or partially integrated with the main microcontroller 60. Similarly, the ETC monitor 64 could be wholly or partially integrated into the throttle position controller 62.

The PCM 42 also receives as an input driver demand signals 66. The driver demand signals can include such things as accelerator pedal position 70, ignition switch position, steering input, brake sensor, transmission position input, as well as inputs from the vehicle speed control system.

In operation, the ETC monitor 64 monitors the accelerator pedal position and engine speed separate from the main microcontroller 60 which executes the primary engine control. In this case, the function of the ETC monitor 64 is to detect throttle position commands as defined by regions 15 and 29 discussed above with respect to FIGS. 1 and 2.

From the inputs of engine speed and accelerator pedal position (PP), the ETC monitor generates a desired throttle position value. The desired throttle position value corresponds to the graphs of FIGS. 1 and 2. Accordingly, a first throttle position value is determined as a function of pedal position as shown in FIG. 1. A second throttle position value is then determined as shown in FIG. 2 for the measured pedal position and engine speed. The desired throttle position value is then clipped to the lesser of the first and second values.

If the commanded throttle position is greater than the desired value, action may be taken to limit the powertrain output. The action can take the form of limiting the commanded throttle position to the desired throttle position value or other powertrain control action can be taken. Powertrain control action can include retarding or eliminating the spark timing of the spark plugs 50, eliminating the signal transmitted to the fuel injectors 48, removing power to the throttle actuator 52 causing a throttle plate 51 to go to a partially open state, and/or varying the amount of exhaust gas recirculation.

Additionally, if the desired throttle position value is exceeded, an indicator can be illuminated on the instrument panel of the vehicle to alert the operator.

From the foregoing, it will be seen that there has been brought to the art a new and improved powertrain control monitor. While the invention has been described in connection with one or more embodiments, it will be understood that the invention is not limited to those embodiments. On the contrary, the invention covers all alternatives, modifications, and equivalents, as may be included within the spirit and scope of the appended claims.

What is claimed is:

1. A method of monitoring the powertrain output controller for an internal combustion engine responsive to an accelerator pedal input, said engine having a throttle responsive to a commanded throttle position signal and an engine speed sensor for providing an engine speed signal, the method comprising the steps of:

determining the accelerator pedal position;

generating a first value as a function of the accelerator pedal position only;

generating a second value as a function of the accelerator pedal position and engine speed and setting a desired value to the lesser of the first and second values; and if the commanded throttle position signal is greater than the desired throttle position value, then generating a commanded signal equal to the desired value.

2. A method of monitoring the powertrain output controller for an internal combustion engine responsive to an accelerator pedal input, said engine having a throttle responsive to a commanded throttle position signal, at least one spark plug responsive to a spark timing signal, a throttle responsive to a throttle position command signal, an exhaust gas recirculation passage, and a speed sensor for providing an engine speed signal the method comprising the steps of:

determining the accelerator pedal position;

generating a first throttle position value as a function of the accelerator pedal position; and generating a second throttle position value as a function of the accelerator pedal position and engine speed and, if the commanded throttle position is greater than the first or second throttle position values, then adjusting the power delivered to the engine by setting the commanded throttle position value to the lesser of the first and second throttle position values.

3. The monitoring method of claim 2 wherein the step of adjusting the power delivered to the engine includes the step of modifying the throttle position command signal.

4. The monitoring method of claim 2 wherein the step of adjusting the power delivered to the engine includes the step of modifying the fuel signal.

5. The monitoring method of claim 2 wherein the step of adjusting the power delivered to the engine includes the step of modifying the amount of exhaust gas recirculated into the engine.

6. The monitoring method of claim 2 wherein the step of adjusting the power delivered to the engine includes the step of modifying the spark timing signal.

7. A control system for an internal combustion engine responsive to an accelerator pedal input, said engine having at least one fuel injector responsive to a commanded fuel signal, at least one spark plug responsive to a spark timing signal and a throttle responsive to a commanded throttle position, the system comprising:

an accelerator pedal position sensor for providing an accelerator pedal position value;

an engine speed sensor for providing an engine speed value;

a control unit including a microprocessor for receiving the accelerator pedal position value and engine speed value, the microprocessor programmed to perform the following steps:

generate a first value as a function of the accelerator pedal position value;

generate a second value as a function of the accelerator pedal position value and engine speed value; and if the commanded throttle position is greater than the first or second values, then set the commanded throttle position value equal to the lesser of the first and second values.

8. A method for a powertrain controller for an internal combustion engine responsive to an accelerator pedal input said engine having a throttle responsive to a commanded throttle position signal, at least one spark plug responsive to a spark timing signal, an exhaust gas recirculation passage, and a speed sensor for providing an engine speed signal the method comprising the steps of:

determining the accelerator pedal position;

generating a first throttle position value as a function of the accelerator pedal position; and generating a second throttle position value as a function of the accelerator pedal position and engine speed and;

if the commanded throttle position is greater than the first or second throttle position values, then setting the commanded throttle position to the lesser of the first and second throttle position values and indicating the same.

9. The method of claim 8 wherein the step of indicating includes the step of illuminating an indicator on an operator instrument panel for the engine.

10. The method of claim 8 wherein the step of indicating includes the step of illuminating an indicator on an operator instrument panel for the engine.

* * * * *